US005261836A

United States Patent [19]

Okabe

[11] Patent Number: 5,261,836

[45] Date of Patent: Nov. 16, 1993

[54] METAL TERMINAL DUAL-LOCK CONNECTOR

[75] Inventor: Toshiaki Okabe, Shizuoka, Japan

[73] Assignee: Yazaki Corporation, Tokyo, Japan

[21] Appl. No.: 940,231

[22] Filed: Sep. 3, 1992

[30] Foreign Application Priority Data

Sep. 11, 1991 [JP] Japan ..... 3-073103[U]

[51] Int. Cl.[5] ..... H01R 13/40

[52] U.S. Cl. ..... 439/595; 439/598; 439/752

[58] Field of Search ..... 439/595, 598, 599, 752

[56] References Cited

U.S. PATENT DOCUMENTS

| | | | |
|---|---|---|---|
| 4,944,695 | 7/1990 | Tsuji et al. | 439/595 |
| 4,975,082 | 12/1990 | Nagasaka et al. | 439/595 |
| 5,088,938 | 2/1992 | Murakami et al. | 439/595 |
| 5,176,537 | 1/1993 | Samejima et al. | 439/595 |

FOREIGN PATENT DOCUMENTS

| | | |
|---|---|---|
| 54-126990 | 10/1979 | Japan . |
| 55-36550 | 3/1980 | Japan . |
| 62-1382 | 1/1987 | Japan . |

*Primary Examiner*—Paula A. Bradley
*Attorney, Agent, or Firm*—Sughrue, Mion, Zinn, Macpeak & Seas

[57] ABSTRACT

A connector for retaining metal terminals in a dual manner. The connector includes a connector housing (A) having terminal receiving chambers (3) therein. The connector housing includes a flexible retaining arm (9) extending from one wall (8) of the chamber for retaining the metal terminal (C), with a flexing space (10) being formed between the flexible retaining arm and the one wall. Additionally, the connector housing includes a fixed retaining projection (7) formed on another wall (6) opposed to the one wall. A retainer (B) is connectable to a front end of the connector housing and movable from a provisionally-connected condition to a completely-connected condition. In the provisionally-connected condition the metal terminal is retained by the retaining arm, and in the completely-connected condition the retainer is received in the flexing space to deflect the flexible retaining arm toward the other wall, to engage the metal terminal with the fixed retaining projection.

7 Claims, 4 Drawing Sheets

METAL TERMINAL DUAL-LOCK CONNECTOR

BACKGROUND OF THE INVENTION

1. Field of the Invention

This invention relates to a metal terminal dual-lock connector used, for example, for connecting a wire harness of an automobile.

2. Background

A conventional connector is disclosed in Japanese Laid-Open Utility Model Application No. 62-1382 and illustrated in FIG. 6. The connector includes connector housing a having terminal receiving chambers b. A fixed retaining projection d for engagement with a metal terminal c is formed on an inner wall surface of each terminal receiving chamber b. A flexible arm f is formed on the wall which opposes the fixed retaining projection d for urging the metal terminal c, inserted into the chamber, toward the fixed-retaining projection d. A flexing space e is provided between adjacent arms f for receiving a retainer to secure the flexible arms and to attendantly secure engagement of the metal terminals c with the respective fixed retaining projections d. As a result, rearward withdrawal of the metal terminals c is prevented.

In another conventional connector disclosed in Japanese Laid-Open Utility Model Application No. 55-36550 and shown in FIG. 7(A), there are provided a connector housing a', terminal receiving chambers b', fixed retaining projections d' for engaging the metal terminals c', a flexing space e', and flexible arms f', as with the connector illustrated in FIG. 6. For releasing the engagement of the retaining projections d' from the metal terminal c', a jig i is inserted into a jig insertion groove h to press the metal terminal c' downwardly against the resiliency of the flexible arm f', and in this condition the metal terminal is withdrawn.

The problem with the above connector is that the flexible arm does not function to retain the metal terminal in the chamber, and the jig insertion groove must be provided for the withdrawal of the metal terminal.

SUMMARY OF THE INVENTION

It is an object of this invention to provide a construction in which the flexible arm performs a terminal retaining function, and the removal of a terminal can be performed easily.

The above object has been achieved by a metal terminal dual-lock connector comprising a connector housing having a cantilever-type flexible retaining arm for retaining a metal terminal, which arm is formed on one wall of a terminal receiving chamber to form a flexing space between the flexible retaining arm and the one wall, the connector housing having a fixed retaining projection for retaining the metal terminal which projection is formed on another wall opposed to the one wall; and a retainer connectable to a front end of the connector housing. The flexible retaining arm is displaceable through the flexing space to be engaged with the inserted metal terminal. In a completely-connected condition of the retainer, the retainer is received in the flexing space to drive the flexible retaining arm, supporting the metal terminal, toward the another wall, to engage the metal terminal with the fixed retaining projection in a direction of forward and backward movement.

In a provisionally-connected condition of the retainer, when the metal terminal is inserted into the terminal receiving chamber, the metal terminal is retained only by the flexible retaining arm. When the retainer is moved to the completely-connected position, the metal terminal is retained by the flexible retaining arm and the fixed retaining projection.

DESCRIPTION OF THE PREFERRED EMBODIMENT

Figure 1A:
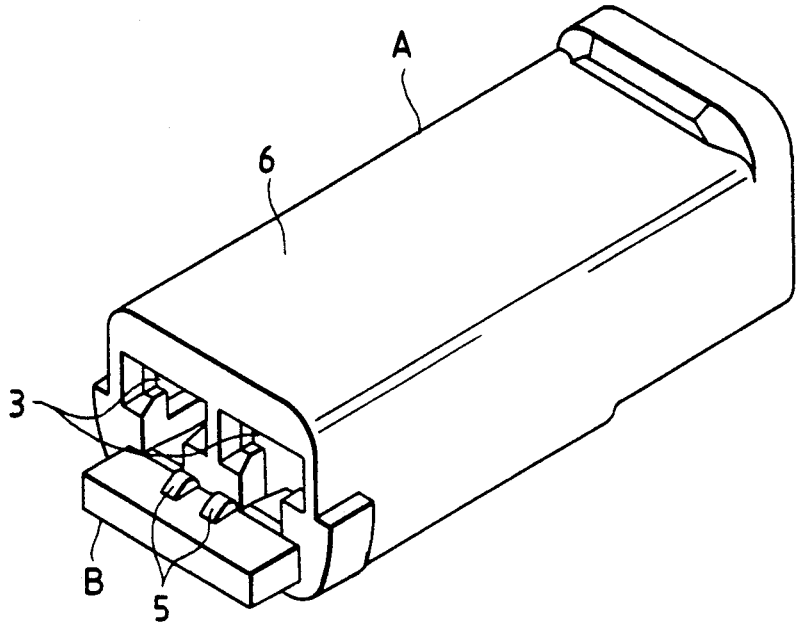
FIG. 1(A) is a perspective view of a preferred embodiment of the present invention, showing a retainer in its provisionally-connected condition.
Figure 1B:
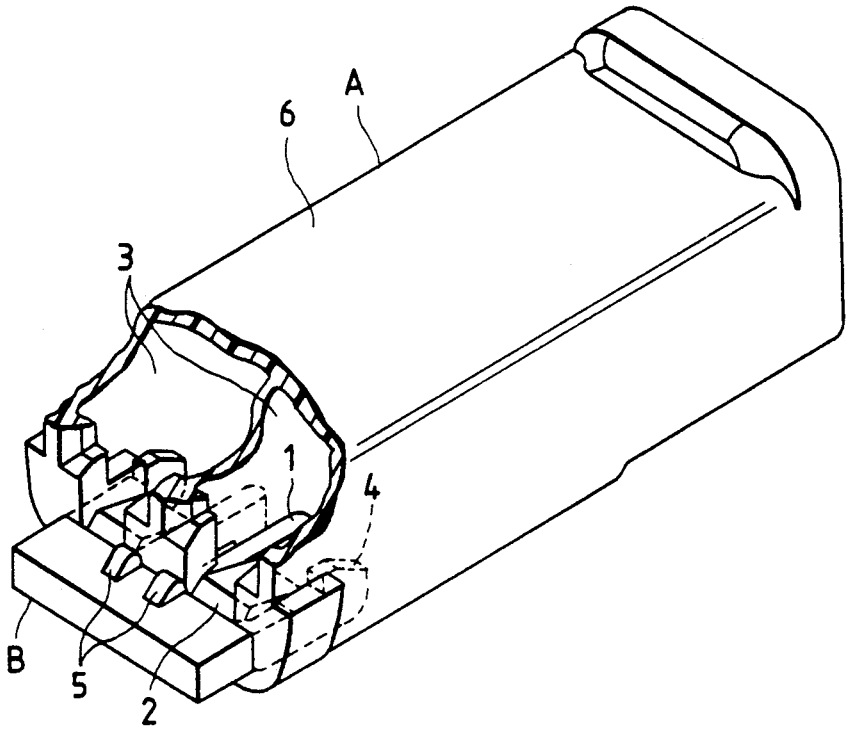
FIG. 1(B) is a perspective view of the preferred embodiment which is partically cut, showing a retainer in its provisionally-connected condition.

In FIGS. 1(A) and 1(B), reference character A denotes a connector housing made of a synthetic resin, and reference character B denotes a retainer made of a synthetic resin, with the retainer B disposed in a provisionally-connected condition with respect to the connector housing A.

Figure 2:
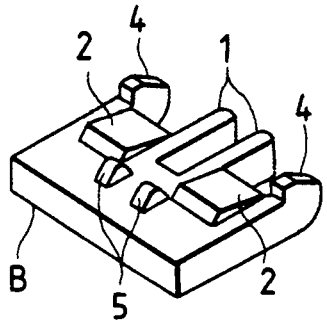
FIG. 2 is a perspective view of the retainer.

Referring also to FIG. 2, the retainer included two tapered drive projections 2 on a front portion thereof which are adapted to be mated respectively with two terminal receiving chambers 3 of the connector housing A. The tapered projections are respectively disposed on opposite sides of a fitting guide portion 1. Provisionally-retaining projections 4 are respectively formed on opposite sides of the front portion of the retainer, and completely-retaining projections 5 are formed on a central section of the rear portion of the retainer.

Figure 3:
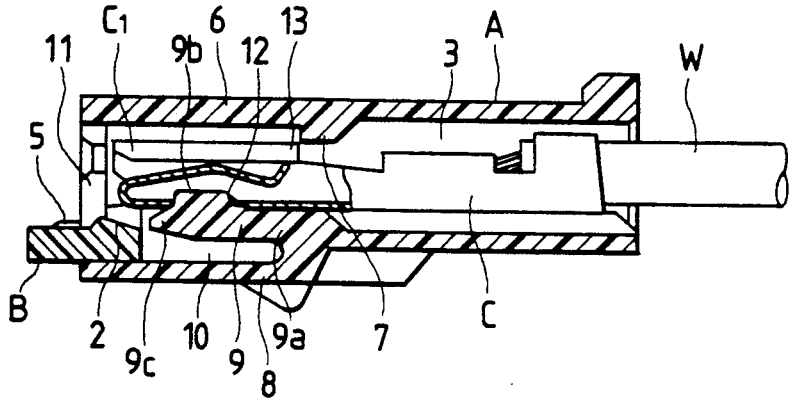
FIG. 3 is a vertical cross-sectional view showing the provisionally-connected condition of the retainer.
Figure 4:
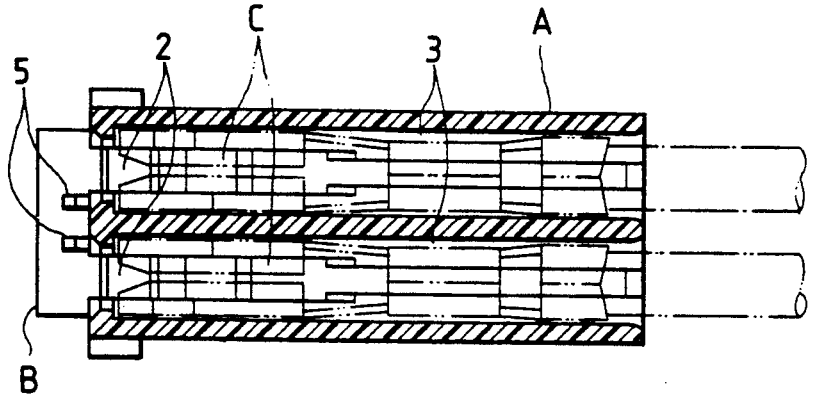
FIG. 4 is a horizontal cross-sectional view showing the above condition.

Referring to FIG. 3, each of the terminal receiving chambers includes a fixed retaining projection 7 formed on an upper wall 6 of the chamber 3, and a flexible retaining arm 9 formed on a bottom wall 8 of the chamber and extending forwardly from its rear proximal end 9*a*. A retaining projection 9*b* for retaining a metal terminal C is formed on the inside of the free end of the flexible retaining arm 9, and a flexing space 10 is formed between the outside of the flexible retaining arm and the bottom wall 8.

In the provisionally-connected condition, illustrated in FIG. 3, the retainer B is disposed so that the drive projections 2 are positioned forwardly of the flexing space 10 such that the retaining arms may be deflected inwardly. In this condition, when the metal terminal C is inserted into the terminal receiving chamber 3 from the rear end thereof, the metal terminal C deflects the flexible retaining arm 9 into the flexing space 10, and then slides over the retaining projection 9*b*, and impinges on a stopper 11. In this position, the flexible retaining arm 9 is restored to its undeflected position so that the retaining projection 9*b* engages engagement portion 12 of an electrical connection portion $C_1$ of the metal terminal.

Figure 5A:
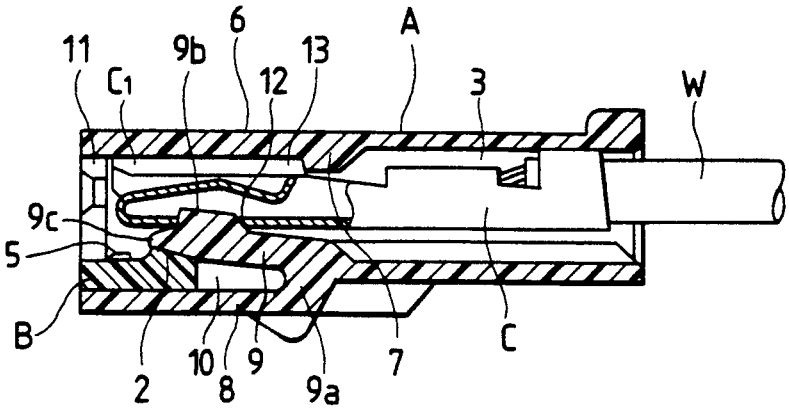
FIG. 5(A) is a vertical cross-sectional view showing a completely-connected condition of the retainer.
Figure 5B:
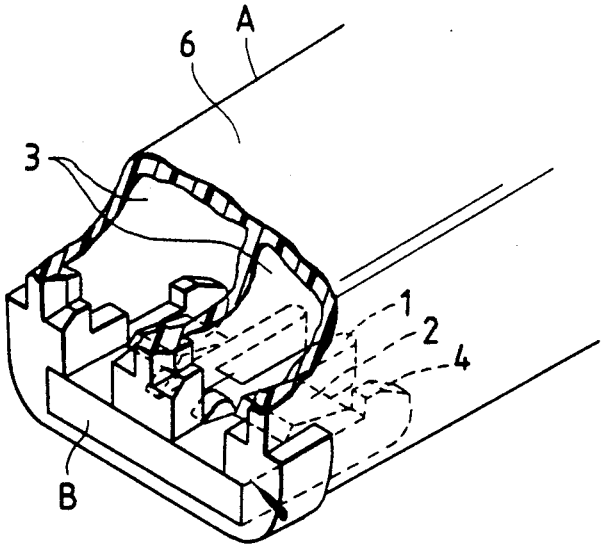
FIG. 5(B) is a perspective view of the preferred embodiment which is partically cut, showing the retainer in its completely-connected condition.
Figure 6:
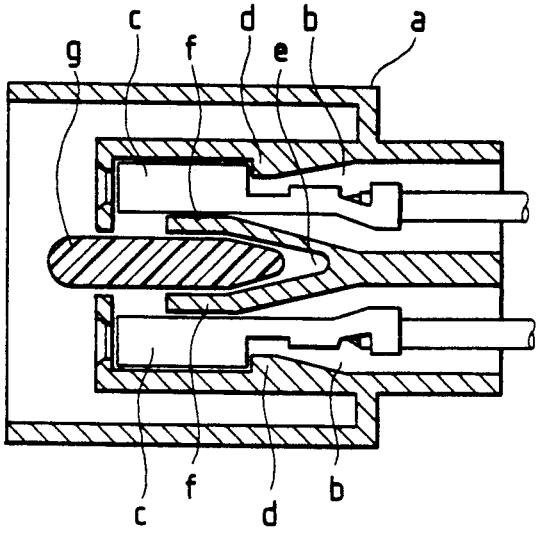
FIG. 6 PRIOR ART
FIG. 6 is a cross-sectional view of a conventional connector.
Figure 7A:
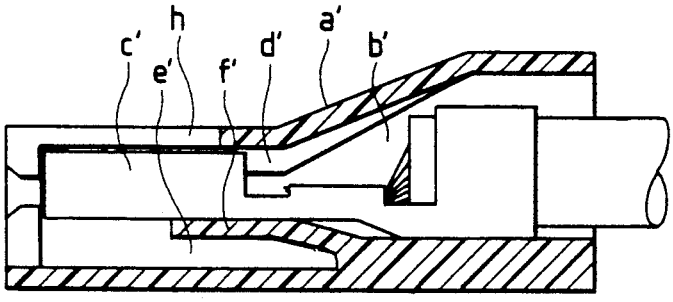
FIG. 7(A) PRIOR ART
FIG. 7(A) is a cross-sectional view of another conventional connector, showing a retained condition of a metal terminal.
Figure 7B:
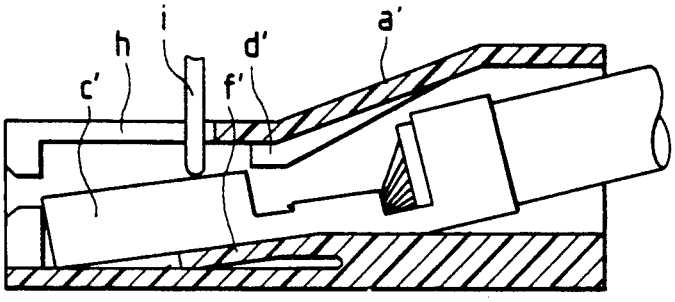
FIG. 7(B) PRIOR ART
FIG. 7(B) is a cross-sectional view of the connector of FIG. 7(A), showing the manner of removing the metal terminal.

In the provisionally-connected condition shown in FIG. 3, a shoulder 13 of the electrical connection portion $C_1$ of the metal terminal C is out of engagement with the fixed retaining projection 7 such that the terminal is capable of being moved in the forward and backward directions. However, when the retainer B is inserted into the completely-connected condition shown in FIGS. 5(A) and 5(b), the tapered drive projection 2 urges the flexible retaining arm 9 and the metal terminal C toward the upper wall 6, so that the shoulder 13 is engaged with the fixed retaining projection 7 in the direction of forward and backward movement. Therefore, in the completely-connected condition, the metal terminal C is retained in a dual manner against rearward withdrawal by the fixed retaining projection 7 and the retaining projection 9*b* of the flexible retaining arm 9.

When it becomes necessary to remove the metal terminal C because of its malfunction or the like, the retainer B is returned to the provisionally-connected condition whereupon the flexible retaining arm 9 and the metal terminal C are restored to their respective positions shown in FIG. 3. In this condition, the flexible retaining arm 9 is deflected by a jig (not shown) into the flexing space 10 with the jig engaging a driven portion 9*c* on the front end of the retaining arm. As a result, the retaining projection 9*b* is disengaged from the engagement portion 12, and the metal terminal C is removed by pulling on an electric wire W.

As described above, in the present invention, the connector housing the cantilever-type flexible retaining arm for primarily retaining the metal terminal which arm is formed on one wall of the terminal receiving chamber to form the flexing space between the flexible retaining arm and the one wall. Additionally, the connector housing includes the fixed retaining projection for secondarily retaining the metal terminal, which projection is formed on another wall opposed to the one wall. The retainer is connectable to the front end of the connector housing so as to deflect the flexible retaining arm such that it engages the inserted metal terminal. In the completely-connected condition of the retainer, the retainer is received in the flexing space to drive the flexible retaining arm, supporting the metal terminal, toward the opposite wall, to engage the metal terminal with the fixed retaining projection in the direction of forward and backward movement. Therefore, the metal terminal can be retained in a dual manner against the rearward withdrawal by the flexible retaining arm and the fixed retaining projection. Further, in the condition in which the connection of the retainer is not completed, the flexible retaining arm does not urge the metal terminal to the position where the metal terminal is engaged with the fixed retaining projection, and therefore the metal terminal can be easily removed.

What is claimed is:

1. A connector for retaining a metal terminal in a dual manner, comprising:

a connector housing having a terminal receiving chamber therein and including:

a flexible retaining arm extending form one wall of said chamber for retaining said metal terminal, a flexing space being formed between said flexible retaining arm and said one wall, and a fixed retaining projection formed on another wall opposed to said one wall; and a retainer connectable to a front end of said connector housing and movable from a provisionallyconnected condition to a completely-connected condition;

wherein in said provisionally-connected condition said metal terminal is retained by said flexible retaining arm, and in said completely-connected condition said retainer is received in said flexing spaced to deflect said flexible retaining arm, and attendantly said metal terminal, toward said another wall so as to urge said metal terminal into engagement with said fixed retaining projection.

2. The connector of claim 1, wherein said flexible retaining arm extends from said one wall in a cantilevered manner.

3. The connector of claim 1, further comprising means for securing said retainer to said connector housing in said provisionally-connected condition.

4. The connector of claim 1, further comprising means for retaining said retainer to said connector housing in said completely-connected condition.

5. The connector of claim 1, wherein said flexible retaining arm includes a projection at a distal end thereof for engaging said metal terminal.

6. The connector of claim 1, wherein said flexible retaining arm includes a jig receiving portion at a distal end thereof for receiving a jig for deflecting said retaining arm into said flexible flexing space.

7. The connector of claim 1, wherein during insertion of said metal terminal into said chamber, said flexible retaining arm is deflected into said flexing space.

* * * * *